US009380890B2

(12) United States Patent
Mustari

(10) Patent No.: US 9,380,890 B2
(45) Date of Patent: Jul. 5, 2016

(54) ARTICLE SUSPENSION APPARATUS

(71) Applicant: Ellena M. Mustari, Colts Neck, NJ (US)

(72) Inventor: Ellena M. Mustari, Colts Neck, NJ (US)

( * ) Notice: Subject to any disclaimer, the term of this patent is extended or adjusted under 35 U.S.C. 154(b) by 0 days.

(21) Appl. No.: 14/626,502

(22) Filed: Feb. 19, 2015

(65) Prior Publication Data

US 2015/0233639 A1 Aug. 20, 2015

Related U.S. Application Data

(60) Provisional application No. 61/941,662, filed on Feb. 19, 2014.

(51) Int. Cl.
*A47F 5/04* (2006.01)
*A47G 25/06* (2006.01)
(Continued)

(52) U.S. Cl.
CPC . *A47F 5/04* (2013.01); *A47B 61/02* (2013.01); *A47B 96/1425* (2013.01); *A47F 5/02* (2013.01); *A47F 5/06* (2013.01); *A47F 7/24* (2013.01); *A47G 25/0664* (2013.01);
(Continued)

(58) Field of Classification Search
CPC ..... A47B 49/00; A47B 46/00; A47B 49/004; A47B 61/003; A47B 81/065; A47B 61/02; A47B 96/1425; A47G 25/0664; A47G 25/0685; A47G 25/06; A47G 25/743; A47G 25/746; A47G 25/0671; A47G 25/02; A47F 5/0006; A47F 5/0087; A47F 5/04; A47F 5/05; A47F 5/106; A47F 5/02; A47F 7/19; A47F 7/24; A47F 5/0081; A47F 5/06; A47F 5/08; A47K 10/04; D06F 57/04; F26B 9/10
USPC ..... 211/205, 85.3, 196, 197, 166, 107, 100, 211/99, 101, 88.04, 16, 133.4, 171
See application file for complete search history.

(56) References Cited

U.S. PATENT DOCUMENTS 445,633 A * 2/1891 Becker ..... 248/165
983,589 A 2/1911 Wendt
(Continued)

FOREIGN PATENT DOCUMENTS

CA 1241302 A1 8/1988
CA 2576662 A1 8/2007

OTHER PUBLICATIONS

QVC, KitchenAid Pasta Drying Rack, http://www.qvc.com/KitchenAid-Pasta-Drying-Rack.product.K123896.html.
(Continued)

*Primary Examiner* — Joshua Rodden
*Assistant Examiner* — Hiwot Tefera
(74) *Attorney, Agent, or Firm* — Kim Winston LLP

(57) ABSTRACT

Apparatus for hanging articles including a central support member defining a shaft having a vertical axis. Item hanging members or arms extend radially from the central support member and are adapted to pivot thereabout to enable spacing between the arms in arcs surrounding the central support member. One or more of the arms may be telescopic in length to enable larger numbers and sizes of articles to be suspended from the arms. In addition, the apparatus may include a sleeve which may be slid over the arms and from which may depend one or more preferably non-destructive suspension devices such as magnetic clips for suspending comparatively small items such as socks. The apparatus may further include a pouch which may likewise be slid over one or more of the arms and which may hold sundries.

9 Claims, 5 Drawing Sheets

(51) Int. Cl.

| | |
|---|---|
| ***A47B 61/02*** | (2006.01) |
| ***A47B 96/14*** | (2006.01) |
| ***A47F 5/02*** | (2006.01) |
| ***A47F 5/06*** | (2006.01) |
| ***A47F 7/24*** | (2006.01) |
| ***D06F 57/04*** | (2006.01) |
| *F26B 25/18* | (2006.01) |
| *F26B 9/10* | (2006.01) |

(52) U.S. Cl.
CPC ..... *A47G 25/0685* (2013.01); *D06F 57/04* (2013.01); *F26B 9/10* (2013.01); *F26B 25/18* (2013.01)

(56) References Cited

U.S. PATENT DOCUMENTS

| | | | | |
|---|---|---|---|---|
| 1,581,463 | A | 4/1926 | Moors | |
| 2,289,450 | A | 7/1942 | Pollard et al. | |
| 2,789,703 | A | 4/1957 | Kurtz | |
| 2,903,227 | A * | 9/1959 | De Kalb Key | A47B 96/1425 211/86.01 |
| 3,310,180 | A * | 3/1967 | Neagle | 211/205 |
| 3,635,352 | A * | 1/1972 | Brooks et al. | 211/47 |
| 4,548,328 | A * | 10/1985 | Brauning | 211/205 |
| 5,038,945 | A * | 8/1991 | Melkonian | A47J 47/16 211/41.11 |
| 5,104,269 | A * | 4/1992 | Hardison | 410/149 |
| 5,143,231 | A * | 9/1992 | Chang | 211/96 |
| 5,219,081 | A | 6/1993 | Lin | |
| 5,236,095 | A * | 8/1993 | Krizka | 211/96 |
| 5,284,260 | A | 2/1994 | Caligiuri, Sr. | |
| 5,299,697 | A | 4/1994 | Ho et al. | |
| 5,318,189 | A | 6/1994 | Lee | |
| 5,449,073 | A * | 9/1995 | DeBeverly | 211/85.2 |
| 5,535,896 | A | 7/1996 | Morgan, Sr. | |
| 5,702,010 | A * | 12/1997 | Liang | D06F 57/122 211/105.1 |
| 6,206,210 | B1 * | 3/2001 | Reed | 211/96 |
| 6,568,546 | B1 | 5/2003 | Huang | |
| 6,749,073 | B2 | 6/2004 | McNab | |
| 6,808,078 | B2 * | 10/2004 | Ta | 211/116 |
| 7,165,689 | B2 | 1/2007 | McDaniel | |
| 8,020,716 | B2 | 9/2011 | Vitale | |
| 2002/0158033 | A1 * | 10/2002 | Chen | 211/103 |
| 2008/0169253 | A1 * | 7/2008 | Vitale | 211/85.7 |
| 2009/0139945 | A1 * | 6/2009 | Jacobson et al. | 211/113 |
| 2011/0042335 | A1 * | 2/2011 | McNicholas | 211/85.3 |
| 2011/0114586 | A1 | 5/2011 | Guzy | |
| 2012/0024808 | A1 | 2/2012 | Jackson et al. | |
| 2012/0138557 | A1 * | 6/2012 | Lee | 211/85.3 |
| 2013/0037503 | A1 | 2/2013 | Cimino et al. | |

OTHER PUBLICATIONS

ICollector, Primitive Pease Clothes Tree Drying Rack, http://www.icollector.com/Primitive-Pease-Clothes-Tree-drying-rack-mfgd-in-Dexter-MA-wooden-3-tier-rack-w-orig-white-paint_i9876330.

QVC, The Green Tree Foldable Heavy Duty Drying and Storage Rack, http://www.qvc.com/The-Green-Tree-Foldable-Heavy-Duty-Drying-and-Storage-Rack.product.V31726.html.

Alibaba, Clothes Drying Rack Stand, http://www.alibaba.com/product-detail/JP-CR0606-Clothes-Drying-Rack-Stand_1553608691.html.

ARTEK, Clothes Tree 160, http://www.artek.fi/products/other/225.

Fishiron, Tobi Clothes Tree Hanger Stand, http://fishiron.ecrater.com/p/9756444/tobi-clothes-tree-hanger-stand, printed Feb. 27, 2013.

* cited by examiner

ARTICLE SUSPENSION APPARATUS

CROSS-REFERENCE TO RELATED APPLICATION

The present application claims the benefit of priority pursuant to 35 U.S.C. §119(e) of U.S. Provisional Application No. 61/941,662, filed Feb. 19, 2014, the entire disclosure of which is hereby incorporated herein by reference.

BACKGROUND OF THE INVENTION

The present invention relates generally to an apparatus for hanging articles or items. In particular, the present invention relates to an apparatus having multiple movable arms for hanging sundry articles including, without limitation, laundry items.

Washing laundry is an unavoidable task. In many instances, such as where shrinkage and/or article damage would not be an issue, wet clothing may be placed directly into a dryer for drying. However, for items susceptible to shrinkage or damage that may be caused by a dryer, the clothing must be air dried instead. Current clothing drying racks assume a variety of forms, most of which rest on the floor. Some are too small to accept large items or articles of clothing. Others are bulky, unsightly and awkward and need to be set up substantially in the middle of a room where they interfere with passage through the room. In any event, such devices do not have enough rungs to hang an entire load of laundry and the lower rungs of such devices cannot be used because the wet clothing touches the floor. Moreover, conventional drying racks are not ruggedly made and often frequently lose parts as a result of continual opening and closing of the devices.

In contrast to conventional laundry drying racks of the types thus far described, apparatus for hanging items or articles of all kinds have been devised that have a plurality of radially extending supports for suspending laundry and other items. Examples of such apparatus are found in U.S. Pat. Nos. 6,568,546 and 5,535,896. In each of these documents there is disclosed a generally vertically-oriented central support member in the form of a rod or tube defining a generally vertical axis. Several item hanging members or arms extend radially from the central support member and are adapted to pivot within limited or enabling arcs surrounding the central support member.

An advantage of such apparatus is that they enable a number of items to be suspended from the arms in a relatively compact volume or space. A disadvantage of such apparatus is that their arms are fixed in size and pivotable movement is limited which limits the number and sizes of items that they can carry. Furthermore, in the case of laundry drying racks, they are limited in their ability to enable effective drying of large numbers of relatively small laundry items such as socks and the like.

Thus, there is still a need for an article suspension apparatus capable of supporting larger numbers and sizes of articles than presently available apparatus. Such needed apparatus must be of rugged construction and capable of effectively supporting items including wet laundry in a compact volume or space. Such a need is satisfied by the article suspension apparatus of the present invention.

BRIEF SUMMARY OF THE INVENTION

In a first aspect, the present invention provides an apparatus for suspending articles including, without limitation, articles or items of laundry. Indeed, although not limited thereto, the present invention finds beneficial use as a drying rack or laundry tree for suspending wet articles of laundry as they dry. The apparatus comprises a central support member in the form of a rod or tube defining a shaft having a vertical axis. A plurality of article hanging members or arms extend radially from the central support member and are adapted to independently pivot thereabout to enable spacing between the arms in an arc surrounding the central support member. The central support member may be free-standing or self-supporting on a base, compressively anchored between a floor and a ceiling, or it may be secured to a wall via bracket, brace or the like. One or more of the arms may be telescopic in length to enable larger numbers and sizes of articles to be suspended from the arms in comparison to currently known racks of similar construction.

The article suspension apparatus can further include one or more radially positionable arms dedicated to supporting items hung by clothes hangers. In addition, the invention can include a sleeve which may be slid over the arms and from which may depend one or more preferably non-destructive suspension devices such as magnetic clips for suspending comparatively small and/or lightweight items such as socks and undergarments. Furthermore, the article suspension apparatus can include a pouch which may likewise be slid over one or more of the arms and which may hold sundries including, but not limited to, anything suitable for suspending items from the arms such as, for example, magnetic clips or the like.

According to another aspect, the present invention provides an article suspension apparatus comprising a central shaft having a base and a plurality of elongate telescoping support assemblies pivotally connected to the central shaft and extending radially from the central shaft. Each of the plurality of elongate telescoping support assemblies includes a pivoting base member circumscribing the central shaft, and an elongate telescoping support member extending from the pivoting base member.

BRIEF DESCRIPTION OF THE SEVERAL VIEWS OF THE DRAWINGS

The foregoing summary, as well as the following detailed description of the preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
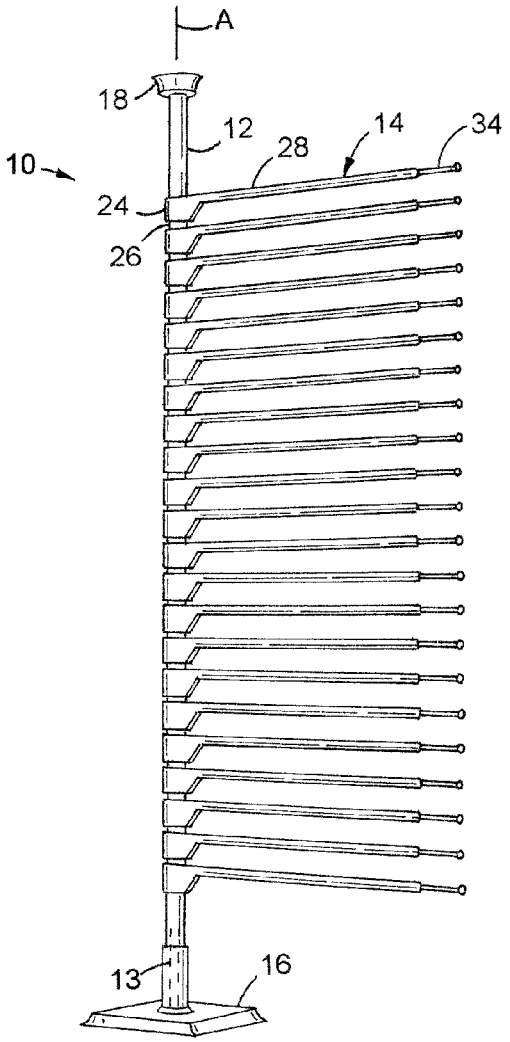
FIG. 1 is a perspective view of a first preferred embodiment of an article suspension apparatus in accordance with the present invention.

Reference will now be made in detail to the preferred embodiments of the invention illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as top, bottom, above, below and diagonal, are used with respect to the accompanying drawings. Such directional terms used in conjunction with the following description of the drawings should not be construed to limit the scope of the invention in any manner not explicitly set forth. Additionally, the term "a," as used in the specification, means "at least one." The terminology includes the words above specifically mentioned, derivatives thereof, and words of similar import.

Referring to FIGS. 1 through 6, the present invention provides for an article suspension apparatus 10 that includes a central support member 12 in the form of a telescoping tube or shaft defining a vertical axis "A". The tube of the central support member 12 is preferably circular in cross-section and is formed from a rigid, durable and non-corrosive material such as aluminum, stainless steel, PVC or the like. The central support member or shaft 12 may be constructed as a compression rod having two relatively slidable hollow cylinders and an internal spring or other biasing member 13 which biases the cylinders apart from one another to an extended position for pressure mounting the central shaft between a floor and a ceiling. According to an aspect, the central support member is adapted to accommodate a room with an 8'-10' ceiling but can alternatively be configured to accommodate rooms with ceiling heights lower than 8' or higher than 10'. In an alternative aspect, the present invention can include the use of wall mounting hardware, described below, for securing the central support member in a substantially vertical stable position. Wall mounting hardware applicable to the present invention is as disclosed in U.S. Pat. No. 5,535,896, the entire disclosure of which is hereby incorporated by reference herein.

As will be discussed in greater detail hereinafter, a plurality of article hanging members or arms 14 extend radially from the central support member 12 and are adapted to independently pivot thereabout to enable spacing between the arms in arcs surrounding the central support member. According to an aspect, the plurality of article hanging members or arms 14 are preferably constructed as a plurality of elongate telescoping support assemblies pivotally connected to the central shaft of the central support member 12 and extending radially from the central shaft. As will be further described below, each of the plurality of elongate telescoping support assemblies includes a pivoting base member circumscribing the central shaft, and an elongate telescoping support member extending from the pivoting base member.

The central support member may be free-standing or self-supporting on a base 16. Base 16 can be square (FIGS. 1 and 2), circular, rectangular or otherwise shaped so long as it is sufficiently large to provide a solid footing for the central support member 12. Alternatively, the central support member may be compressively anchored between a floor and a ceiling between base 16 and a ceiling grip member 18.

Figure 3:
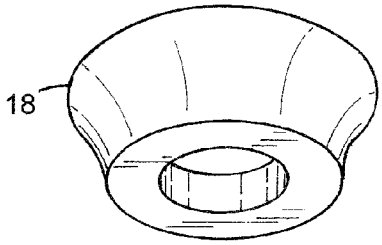
FIG. 3 is a perspective view of a ceiling gripping member for the article suspension apparatus of FIG. 1.
Figure 4:
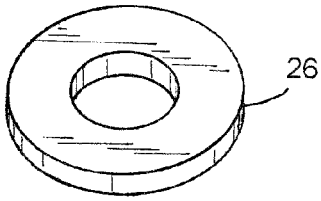
FIG. 4 is a perspective view of a ring-shaped spacer suitable for use with the article suspension apparatus of FIG. 1.
Figure 2:
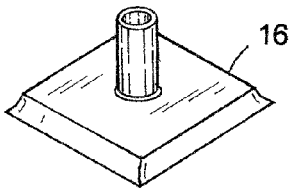
FIG. 2 is a perspective view of a base for the article suspension apparatus of FIG. 1.
Figure 7:
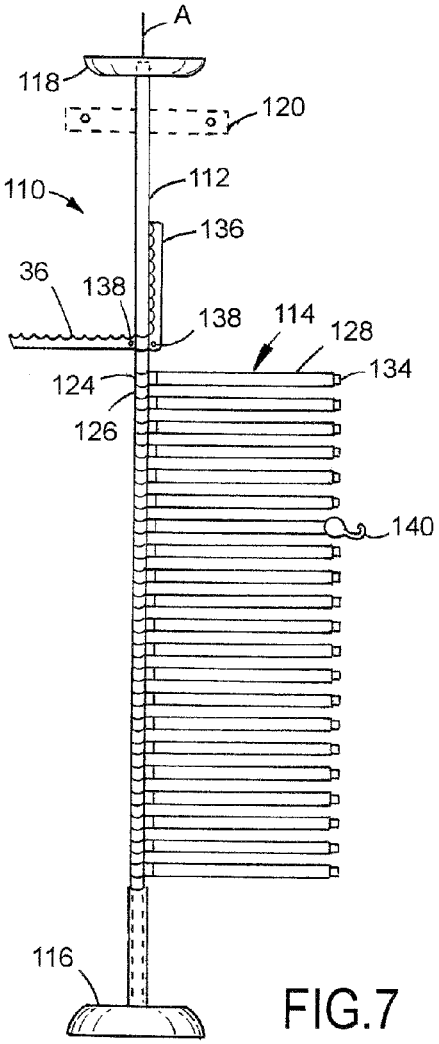
FIG. 7 is a side elevational view of an article suspension apparatus in accordance with another preferred embodiment of the present invention.

As illustrated in FIG. 3, ceiling grip member 18 may be circular (as shown) or it may assume any other shape and dimensions suitable to provide firm compressive contact with an unillustrated ceiling. Preferably, base 16 and grip member 18 are made from rubber or other elastomeric composition or any other material with high stiction or static friction, and are wide enough to stabilize the central support member 12 without causing damage to the floor or ceiling. Still further, especially in circumstances where the ceiling height exceeds approximately 10', the central support member 12 may be secured to a wall via a bracket, brace or the like 120 (FIG. 7). It will be further understood that apparatus 10 (FIG. 1) or apparatus 110 (FIG. 7) is easily movable from one location to another by releasing pressure between the floor and ceiling in order to separate the base 16 and ceiling grip member 18 from the floor and ceiling, moving the apparatus to another location and reapplying pressure between the base 16 and ceiling grip member 18 at the new location.

Figure 5:
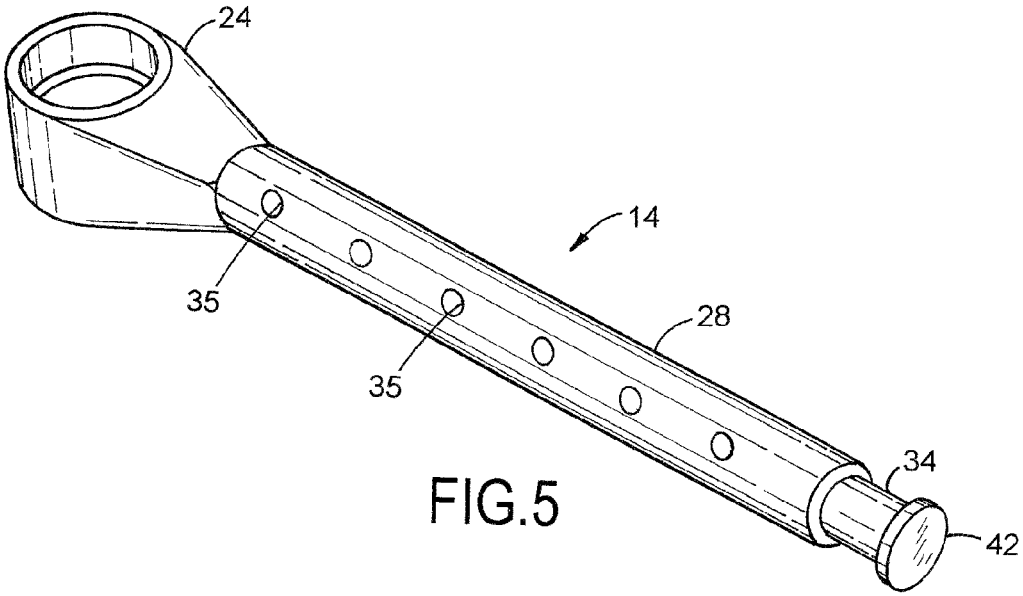
FIG. 5 is a perspective view of an article hanging member applicable to the embodiment shown in FIG. 1.
Figure 6:
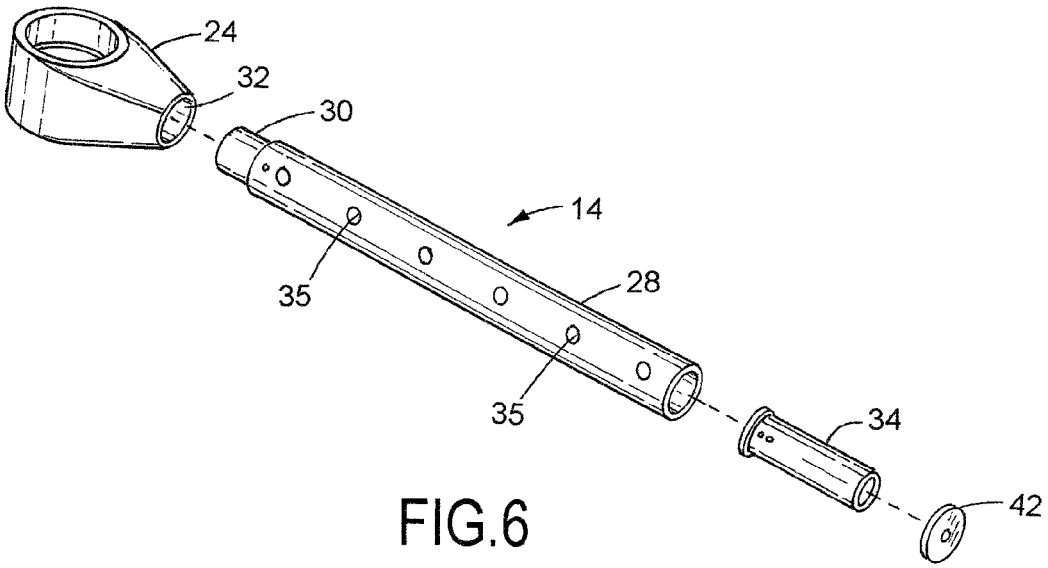
FIG. 6 is an exploded view of the article hanging member of FIG. 5.

Referring to FIGS. 1, 5 and 6, it is seen that the proximal ends of arms 14 preferably comprise article hanging member supports 24 having a diameter slightly larger than that of the shaft of central support member 12 or which can be pre-fitted onto the shaft. Each support 24 is thus preferably constructed as a pivoting base member circumscribing the central shaft of central support member 12. Upon assembly of apparatus 10, one or both of the base 16 and grip member 18 are removed from the central support member 12 and the article hanging member supports 24 or pivoting base members of arms 14 are slid over the shaft of the central support member. Optionally, the pivoting base members 24 and thus arms 14 may be vertically separated by ring-like spacers 26 (FIG. 4) of slightly larger diameter than the shaft of central support member 12 which are slid over the central support member 12 between adjacent pivoting base members 24. The presence of spacers 26 enables easier handling of arms 14 during operation of apparatus 10 and serves to resist unintentional swinging movement between adjacent arms 14 as one arm is swung relative to another. Additionally, the spacers themselves can be stacked thus enabling the user to adjust the spacing between adjacent article hanging members. Both pivoting base members 24 and spacers 26 may be formed from rigid, durable and non-corrosive materials such as metals, polymers (e.g., hard plastics) and composite materials. According to an aspect of the present embodiment, apparatus 10 may be equipped with approximately twenty rotatable arms 14 although a lesser or greater number of arms may be provided depending on article hanging needs and space considerations.

Referring to FIG. 6, it is seen that an elongate telescoping support member extends from the pivoting base member 24 of item hanging member or arm 14. The elongate telescoping support member preferably comprises a hollow tube 28 having a reduced diameter proximal end 30 that is preferably friction fit but releasably connected within corresponding opening 32 provided in ring or pivoting base member 24. At its distal end, tube 28 supports within its interior an extension member 34 which is shown in an extended position in FIG. 1. Because of extension members 34, the arms 14 are telescopic in length to enable larger numbers and sizes of articles to be suspended from the arms in comparison to currently known racks of similar construction. The extension members 34 can be moved manually between retracted and extended positions. According to an aspect, the pivoting base member 24 comprises an axial length greater than the overall width of the elongate telescoping support member and adjacent elongate telescoping support members are spaced apart by the axial length of the pivoting base member 24.

Figure 8:
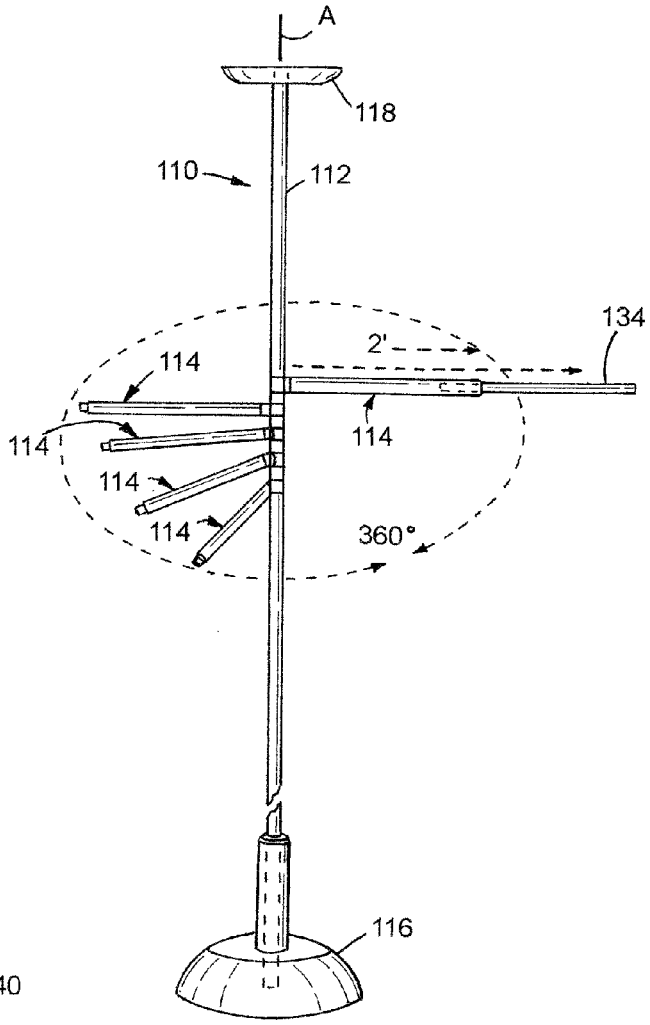
FIG. 8 is a partial perspective and partial side elevation view of the article suspension apparatus of FIG. 7 with several article hanging members thereof shown swung in various degrees of arc about a vertical axis of a central support member.

According to a preferred aspect, the tubes 28 of arms 14 are approximately two feet in length and extension members 34 are capable of extending therefrom up to an additional foot or so. However, it will be understood that the length of arms 14 and the degree of extensibility of extension members 34 may be greater or less than previously described depending on the spatial considerations of the room within which the apparatus 10 may be placed. Referring to FIG. 8, it is seen that, surrounding space permitting, the arms may rotate through an angle of 360° about the shaft of the central support member whereby the arms may be positioned for maximum efficiency for tasks such as drying clothes, particularly large amounts of clothing.

In addition, as seen in FIGS. 5 and 6, the tubes 28 of the telescoping support members or arms 14 can optionally be provided with a plurality of apertures 35 extending along the longitudinal length of the tubes in order to promote air flow through the tubes for drying wet items that may be suspended from the arms.

Figure 9:
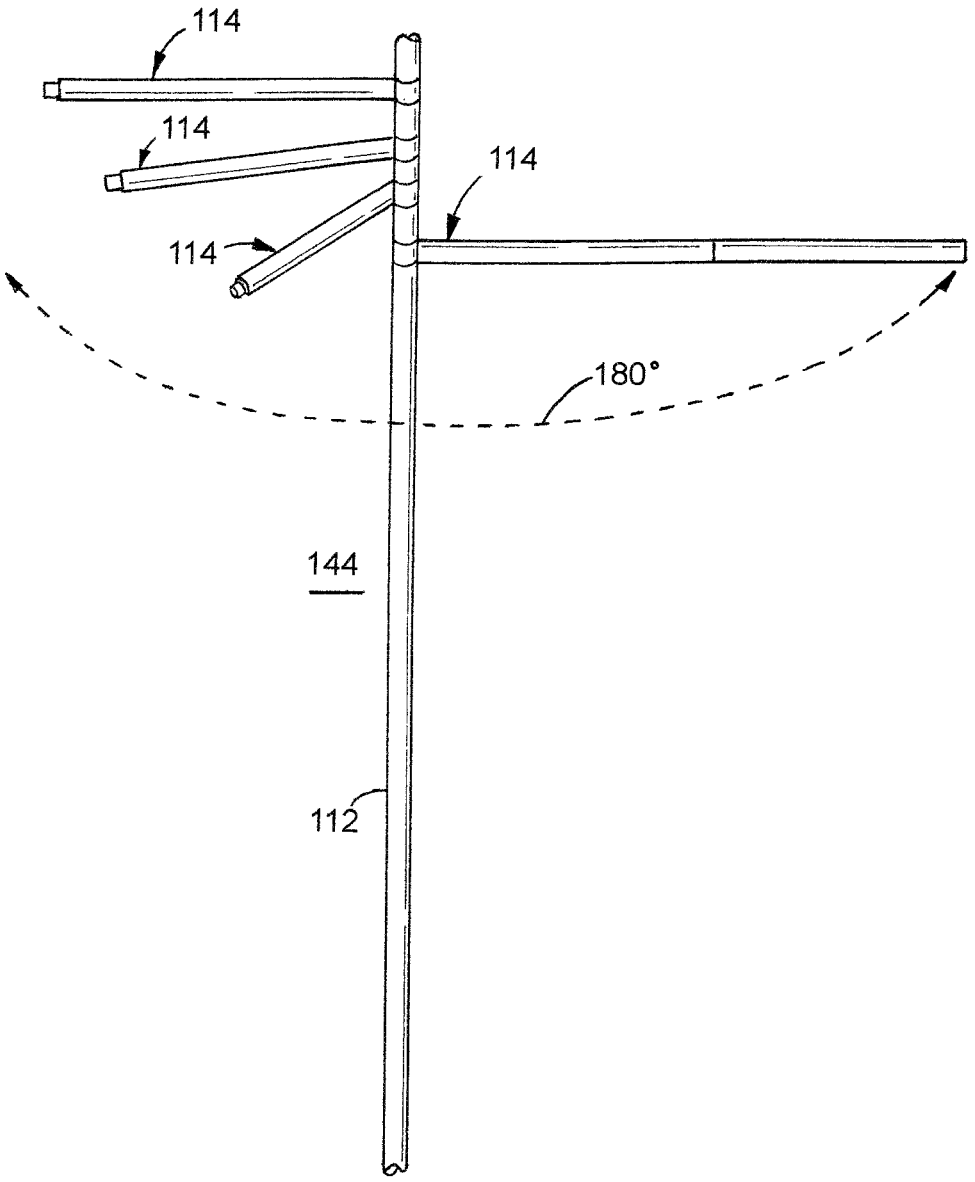
FIG. 9 is a view similar to FIG. 8 showing the article hanging members being rotatable through an arc of approximately 180° when the article suspension apparatus is mounted closely adjacent a wall.

FIGS. 7-9 show another preferred embodiment of the article suspension apparatus 110. The article suspension apparatus 110 is similar to article suspension apparatus 10 but can further include at least one radially extending rod 136 having scalloped edges for receiving the tops of clothes hangers or the like. As will be appreciated, the scalloped edges of rods 136 resist sliding of the clothes hangers along the rods when the rods are deployed. In this regard, rods 136 may be constructed and arranged whereby they may at all times extend radially from the central support member 112 or, as illustrated, they may be pivotably mounted to the central support member at pivots 138 so that they may be swung toward the central support member when not in use. Still further, the distal ends of item hanging members or arms 114 or extension members 134 may be equipped with releasably attachable end caps 140 (only one of which is shown in FIG. 7) formed with upturned ends as an additional or alternative structure for hanging articles or items from the arms 114. Alternatively, as shown in FIGS. 5 and 6, the extension members 34 may be provided with end caps 42 which are preferably friction fit within the extension members 34. The end caps 42 have enlarged diameters relative to the extension members 34 defining stops which prevent clothing or other articles or items from falling from the distal ends of the arms 14 during operation of the apparatus 10.

As noted above, and as shown in FIG. 7, at least the upper end of the central support member 112 may be mounted to a wall via a bracket, brace or the like 120. In such case, the degree of rotation of item hanging members or arms 114 may be somewhat hindered. Indeed, as shown in FIG. 9, the range of motion of arms 114 is limited to about 180° of arc when the central support member 112 is mounted close to a wall 144.

Figure 10:
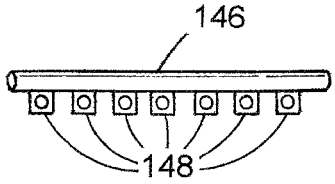
FIG. 10 is a side elevation view of a sleeve that is slidable over an article hanging member of the article suspension device of FIG. 1 or 7 and depicting a plurality of item suspension devices suspended therefrom.

Referring to FIG. 10, there is shown a further aspect of the present invention. In particular, FIG. 10 shows a sleeve 146 that is slidable over an article hanging member or arm 14 or 114. Sleeve 146 may be formed of fabric such as canvas or the like and preferably includes a plurality of non-destructive item suspension devices 148 depending therefrom. Although not limited thereto, devices 148 may be constructed as magnetic clips, rings or other non-destructive members such as spring clips that gently yet firmly retain items onto the sleeve 146. Non-limiting examples of items or articles that may be retained by devices 146 include socks and undergarments.

Figure 11:
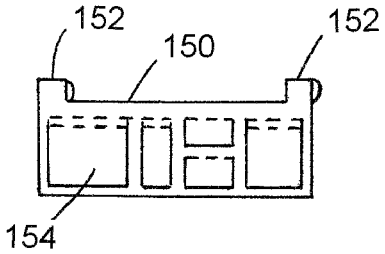
FIG. 11 is a side elevation view of a pouch that is slidable over an article hanging member of the article suspension device of FIG. 1 or 7 and including various compartments for holding sundries.

FIG. 11 reveals a further aspect of the present invention. In FIG. 11 there is shown a pouch 150 that is slidable via loops 152 over an article hanging member or arm 14 or 114. Pouch 150 may be formed of fabric such as canvas or the like and preferably includes a plurality of pockets or compartments 154 for holding sundries including but not limited to laundry items and mating magnetic components of the above-described magnetic clips 148.

When using apparatus 10 or apparatus 110 during a laundering operation, a user would launder a load of laundry which, for fear of damage or shrinkage, cannot be dried in a clothes dryer. Once the cleaning cycle ends, the user would swing arm 14 of apparatus 10 or arm 114 of apparatus 110 into an easily accessible position and then drape or otherwise hang the laundered item over the arm. The user would repeat these steps until all relatively large items of laundry are hung from the arms 14 or 114, making sure that the arms are sufficiently spaced so that the wet clothes do not contact one another. Thereafter, another arm would be swung into position, sleeve 146 would be slid over the arm and smaller items such as socks and undergarments can be gently clipped to the clips 148. Once the laundry has dried, the clothes may be removed from the arms 14 or 114 and the arms may be swung back into substantially coplanar positions, thereby placing the apparatus 10 or 110 in a compact storage state until later use such as shown in FIGS. 1 and 7.

It will be appreciated by those skilled in the art that changes could be made to the embodiments described above without departing from the broad inventive concept thereof. For example, the instant invention may be used in a closet to hang any types of clothing or accessories. Further, it may be used in department stores to hang handbags, scarves, clothing and other items. It can further be deployed in a doctor's office or other professional's office having a waiting room in order to hang magazines or other reading material. It may be used to hang small items such as necklaces, bracelets, headbands, watches, cuffs and the like, and it can also be used to hang artwork and photos. In the home it can be used, in addition to a laundry drying rack, as a rack for drying children's clothing after they have played in the snow. It is to be understood, therefore, that this invention is not limited to the particular embodiment disclosed, but it is intended to cover modifications within the spirit and scope of the present invention as defined by the appended claims.

I claim:

1. An article suspension apparatus comprising:

a central support member defining a shaft having a vertical axis and formed of a non-corrosive material;

a plurality of article hanging members extending radially from the central support member and operable to independently pivot thereabout to enable spacing between individual article hanging members in an arc surrounding the central support member, wherein at least one of the article hanging members is telescopic in length, each article hanging member having an end cap formed with enlarged diameters or upturned ends, and at least one of the article hanging members includes a plurality of ventilation apertures for promoting air flow;

pivoting base members at proximal ends of the article hanging members, each pivoting base member having:

a proximal end circumscribing the central support member, a distal end engaging the article hanging member, and a tapering cross-section extending from the proximal end to the distal end;

a base for securing the central support member to a floor;

an upper support for securing the apparatus against a ceiling having a grip member with high stiction;

a supplemental holder slidable over an individual article hanging member;

spacers of larger diameter than the shaft of the central support member disposed between adjacent pivoting base members; and at least one radially extending rod having scalloped edges, pivotably mounted to the central support member about an axis transverse to the vertical axis.

2. The article suspension apparatus of claim 1, wherein each article hanging member has a reduced diameter proximal end for releasable connection with one of the base members.

3. The article suspension apparatus of claim 1, wherein at least one of the article hanging members include a proximal tube and a distal extension member having a longitudinal length less than half a longitudinal length of the proximal tube.

4. The article suspension apparatus of claim 1, wherein the central support member is a telescoping shaft.

5. The article suspension apparatus of claim 4, wherein the central support member includes a biasing member for biasing the telescoping shaft to an extended position for pressure mounting the central support member shaft between the floor and the ceiling.

6. The article suspension apparatus of claim 1, further comprising a pouch that is slidable over an individual article hanging member, and wherein the pouch includes a plurality of compartments.

7. The article suspension apparatus of claim 1, further comprising a sleeve that is slidable over an individual article hanging member and a plurality of non-destructive item suspension devices depending from the sleeves.

8. The article suspension apparatus of claim 7, wherein the non-destructive item suspension devices are magnetic.

9. The article suspension apparatus of claim 1, further comprising a wall-mountable bracket for securing the central support member to a wall.

* * * * *